US005188078A

United States Patent [19]

Tamaki

[11] Patent Number: 5,188,078

[45] Date of Patent: Feb. 23, 1993

[54] THROTTLE VALVE ASSEMBLY

[75] Inventor: Shigeo Tamaki, Katsuta, Japan

[73] Assignees: Hitachi, Ltd., Tokyo; Hitachi Engineering Co., Ltd., Ibaraki, both of Japan

[21] Appl. No.: 827,746

[22] Filed: Jan. 29, 1992

[30] Foreign Application Priority Data

Jan. 29, 1991 [JP] Japan ..... 3-9274

[51] Int. Cl.[5] ..... F02D 9/10

[52] U.S. Cl. ..... 123/403; 123/52 MC

[58] Field of Search ..... 123/52 MC, 337, 403

[56] References Cited

U.S. PATENT DOCUMENTS 4,452,203 6/1984 Oshika et al. ..... 123/403
4,794,885 1/1989 Honda et al. ..... 123/52 MC
4,848,280 7/1989 Ohtsuka et al. ..... 123/52 MC
4,895,112 1/1990 Rutschmann et al. ..... 123/52 MC
5,012,770 5/1991 Okamoto et al. ..... 123/52 MC

FOREIGN PATENT DOCUMENTS 91431 3/1990 Japan .

*Primary Examiner*—Willis R. Wolfe
*Attorney, Agent, or Firm*—Antonelli, Terry, Stout & Kraus

[57] ABSTRACT

A throttle body comprises a light metal first body having an operation space of a throttle valve and a synthetic resin second body which faces to the first body through a space. The first body and the second body are connected by a connecting member through a seal member.

10 Claims, 5 Drawing Sheets

THROTTLE VALVE ASSEMBLY

FIELD OF THE INVENTION

The present invention relates to a throttle valve assembly which is used for a suction air pipe of an engine.

BACKGROUND OF THE INVENTION

Conventionally, a throttle valve shaft and a throttle valve of the throttle valve assembly have been made by a metal and a throttle body of the throttle valve assembly has been made by a light metal. In recent years, a throttle body is proposed to make in such a manner that a metal member is buried to an inside wall of the throttle body made by a synthetic resin and the throttle valve is installed facing to the metal member of the inside wall of the throttle body for lightening the throttle valve assembly as disclosed in Japanese Patent Laid-Open No. 2-91431 entitled "Throttle valve body" and published on Mar. 30, 1990. When all the throttle body is made by a synthetic resin, since a thermal expansion coefficient of the synthetic resin is large, and shape and thickness of the throttle body near the throttle valve and the throttle valve shaft are complicated and comparatively thick, respectively, deformation of the body near the throttle valve and the throttle valve shaft are large corresponding to the thermal expansion and contraction and the deformation of the body is not uniform. If the worst comes to the worst, the throttle valve abuts on a wall surface of a suction air passage of the throttle body and a supporting portion of the throttle valve shaft is fixed to the throttle valve shaft.

SUMMARY OF THE INVENTION

An object of the present invention is to provide a throttle valve assembly which is capable of lightening without deformation caused by thermal expansion of a throttle body and is capable of preventing a throttle valve from abutting to an inside wall of the throttle body.

For attaining the object mentioned above, the throttle valve assembly of the present invention is characterized in that a supporting portion (hereunder, body A) of the throttle valve and the throttle valve shaft of the throttle body is made by a light metal, another portion (hereunder, body B) connected to the body A is made by a synthetic resin separating from the body A, a gap is provided between the body A and the body B for absorbing thermal expansion of the bodies A and B the bodies A and B are connected through a seal member.

Since the body A, namely a body element for forming an operation space of the throttle valve, is made by a light metal, thermal expansion of the body A is sufficiently small compared with that of the body B. The engine is used in a temperature condition having a wide range from a low temperature of approximately −40° C. to a high temperature of approximately 150° C. The throttle valve assembly of the present invention can secure a smooth throttle valve operation having a small thermal deformation amount under the wide range thermal condition without abutting of the throttle valve to the suction air passage and preventing the throttle valve shaft from fixing to the throttle body based on the above-mentioned constitution of the present invention.

Since the body B is located outside of the throttle valve operating region, the body B does not cause bad influence to the throttle valve operation even when the body B is made by the synthetic resin. According to the above-mentioned constitution, since the body A is made by a light metal in a minimum region which is necessary for operating the throttle valve and the body B is made by a synthetic resin which is lighter than the body A, the throttle valve assembly of the present invention can achieve security of the throttle valve operation and lightening thereof.

Since the gap is provided between the body A and the body B for absorbing the thermal expansions of the bodies A and B in case of connecting the body A and the body B for forming a unitary suction air passage of the throttle body, interference between the body A and the body B caused by the thermal expansions thereof can be prevented and abutting of the throttle valve to the internal wall of the throttle body can be prevented. Although the gap is provided for absorbing the thermal expansions, the seal member provided in the gap prevents leakage of the suction air within the throttle body.

Incidentally, when the light metal body A and the synthetic resin body B are connected uniformly in a process of forming the synthetic resin mold to the body B without separating the body A from the body B, thermal stress is applied to a connecting portion of the bodies A and B depending on the difference of the thermal expansion coefficients of the synthetic resin and the light metal. In this case, if the worst comes to the worst, the connecting portion is peeled off.

DETAILED DESCRIPTION OF THE PREFERRED EMBODIMENTS

Figure 1:
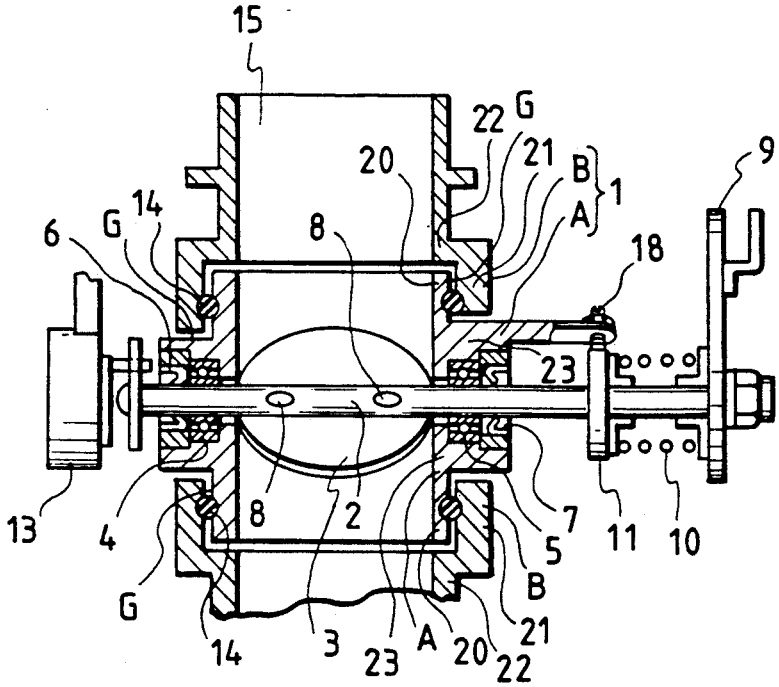
FIG. 1 shows a longitudinal section view of a throttle valve assembly relating to the first embodiment of the present invention.

Referring to FIG. 1, the throttle body 1 is separated into the body A and upper and lower bodies B.

In FIG. 1, the body A is sandwiched between the upper body B and the lower body B. However, generally the body A combined uniformly with the lower body B is connected to the upper body B (hereunder, body B) as shown in FIG. 2, FIGS. 3A and 3B, FIGS. 4A and 4B and FIGS. 5A and 5B.

The body A forms an operation space of the throttle valve 3, namely a space operation region for carrying out an operation of the throttle valve. The body A has a space which is necessary for securing an operation region of the throttle valve. The rest portion of the throttle valve assembly is constituted by the body B. A numeral number 15 denotes a suction air passage within the throttle body 1.

The body A is made by aluminum. The throttle valve shaft 2 passes through the body A. Both ends of the throttle valve shaft are supported by ball bearings 4 and 5, respectively. Seal members, for instance rubber seals 6 and 7, engage holders of the ball bearing 4 and 5, respectively. The throttle valve 3 is fixed by screws 8 on the throttle valve shaft 2. The throttle valve 3 is assembled to the suction air passage within the body A.

A throttle lever 9 and a restricting member 11 for maintaining an open degree of the throttle valve to an inside wall of the body A to a predetermined valve at a starting position of the engine are provided through a return spring 10 on one side of the throttle valve shaft 2. On the other side of the throttle valve shaft, a throttle sensor 13 is provided. The throttle lever 9 operates the throttle valve (3) to open and close directions thereof, corresponding to an acceleration pedal (not shown).

A stopper 18 is used for restricting a rotation of the restricting member 18. The stopper 18 is provided together with the body A. When the throttle valve 3 comes to nearly a fully closed position, the lever 11 abuts the stopper 18.

Generally, a gap formed between the inside wall of the throttle body and the throttle valve is narrow, for example 10–20 $\mu$. If the stopper 18 is provided on the side of the body B, relative position between the restricting member 11 and the stopper 18 is moved on account of thermal deformations of the bodies A and B. In this case, the gap between the inside wall of the throttle body and the throttle valve is changed so that the throttle valve abuts on the inside wall of the body A. For preventing the drawback, the stopper 18 is provided on the side of the body A.

The body B is made by a heat resistant and thermoplastic material such as polybutylene telephthalate PBT or polyethylene telephthalate PET.

The body B is connected to the body A by engaging a surface of an end portion 22 of the body B, an inside wall of a projection 21 connected to the end portion and a surface of the projection 21 which faces to a peripheral portion 23 of the body A extending along an axial direction of the throttle valve shaft 2 to an upper and outside surfaces of a projection 20 extending from the peripheral portion 23 along the suction air passage 15 and the surface of the peripheral portion 23. A gap G is provided between the body A and the body B for absorbing thermal expansion coefficients of the bodies A and B at an engaged portion of the bodies A and B. A seal ring 14 made by an elastic body, for instance rubber, is inserted to the gap G formed by an outside surface of the body A and an inside surface of the body B for maintaining air seal. The outside surface of the body A can be connected in press fit to the inside surface of the body B using the seal ring 14 so that the bodies A and B can maintain connecting state by engagement thereof.

According to the embodiment mentioned above, since the body A is made by a light metal such as aluminum and the body B is made by synthetic resin which is lighter than the body A, all the throttle body 1, namely the throttle body assembly, can be made light. When the body A for maintaining a throttle valve operation region is made by aluminum, since thermal expansion coefficient of aluminum is $2.1\times1/10^5$ (mm/° C.) and thermal deformation amount is small under wide range thermal variation so that the throttle valve 3 can be prevented from abutting on the inside wall of the body A and the throttle valve shaft 2 can be prevented from fixing to the throttle body 1.

Although the body B is made by PBT or PET, thermal expansion coefficient thereof is approximately $5\times10^5$ (mm/° C.) and thermal expansion, namely thermal deformation, of the body B is approximately 2.4 times compared with the body A, the thermal expansion deformation is absorbed by the gap G formed between the body A and the body B, breakage caused by the thermal deformation of the throttle body can be prevented.

Since the stopper 18 for restricting open and close of the throttle valve is provided on the side of the body A having a small thermal expansion coefficient, displacement of the stopper position caused by temperature variation and displacement of full close position of the throttle valve caused by the temperature variation are negligible small and air leakage at fully closed position of the throttle valve, which causes suction air flow rate error, can be prevented.

Figure 2:
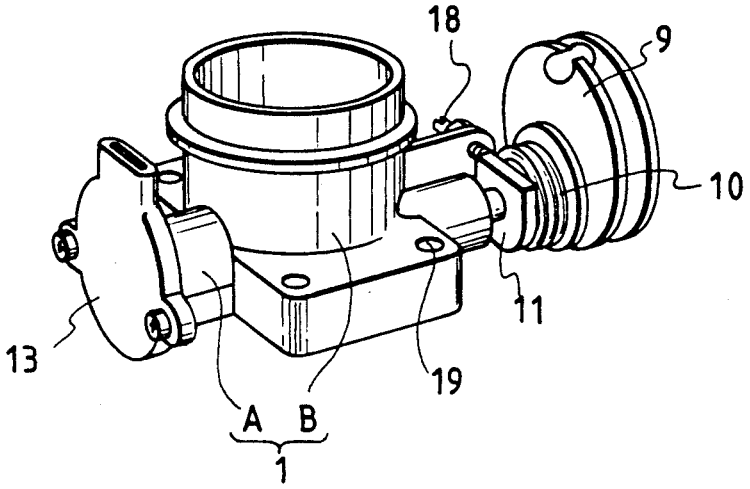
FIG. 2 shows a perspective view of the throttle valve assembly shown in FIG. 1.

In FIG. 2, the same parts as in FIG. 1 are indicated by the same symbols.

Figure 3A:
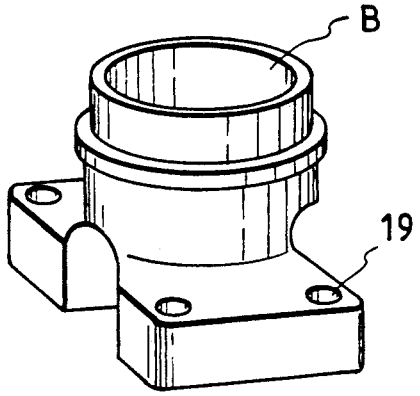
FIGS. 3A and 3B show perspective views of the throttle valve assembly shown in FIG. 1 in which the throttle valve assembly is separated to each body element.
Figure 3B:
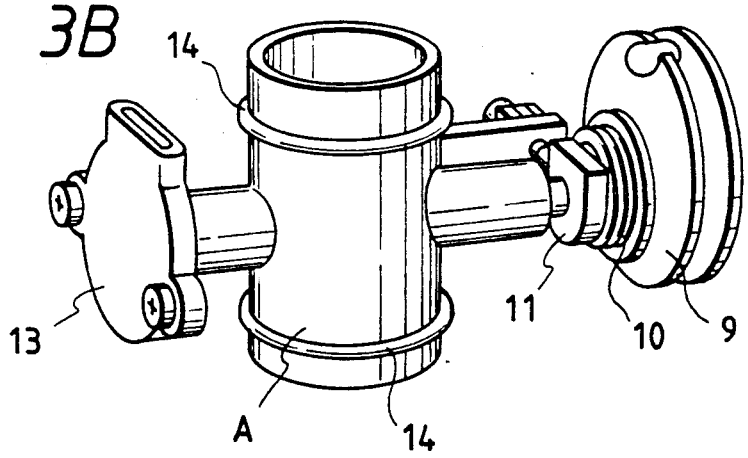

Referring to FIGS. 3A and 3B, the body A shown in FIG. 3B is covered by the body B in the manner shown in FIG. 2. Holes 19 for connecting the body B to the body A are provided along the axis of the throttle valve shaft 2. By inserting bolts (not shown) into the holes 19 of the body B and fastening these bolts to an intake manifold (not shown), the bodies A and B are connected through the rings 14. The light metal body A is connected to the synthetic resin body B. The seal member 14 is formed by O rings.

Figures 4A, 4B:
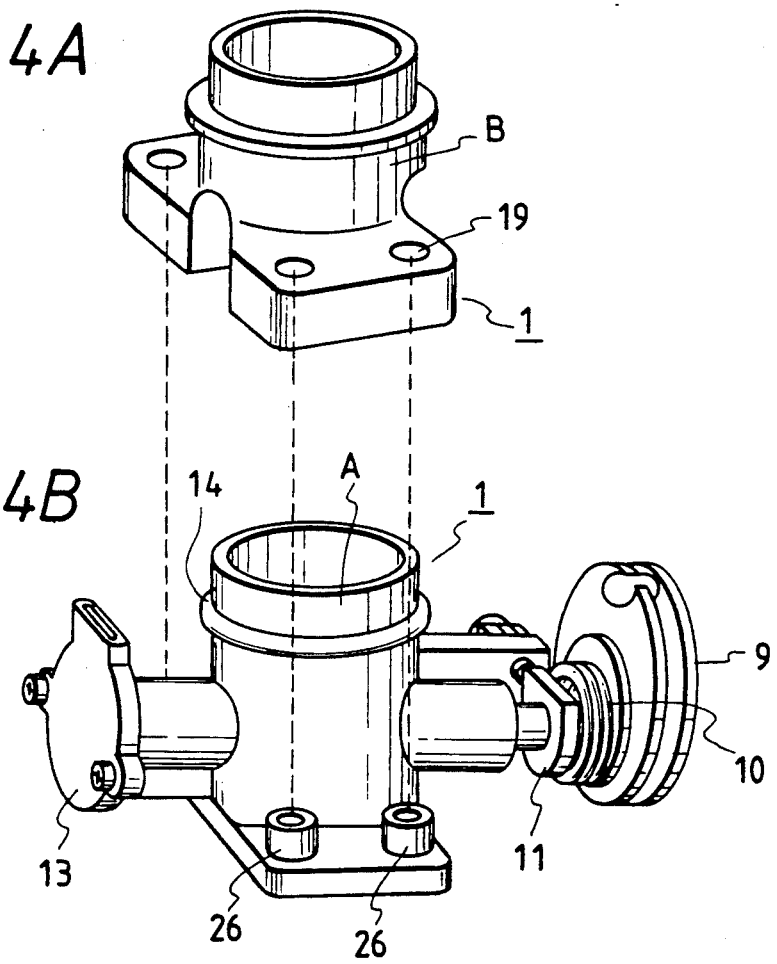
FIGS. 4A and 4B show perspective views of a throttle valve assembly relating to the second embodiment of the present invention, in which the throttle valve assembly is separated to each body element.

In FIGS. 4A and 4B, the same parts as in FIGS. 1 and 3A and 3B are indicated by the same symbols. Different from FIGS. 1 and 3 in FIGS. 4A and 4B, is that protrusions 26 for fixing the bodies A and B are provided at the body A and one O ring is provided. The protrusion 26 is threaded a female screw within an inside thereof. By threading the bolt from the hole 19 to the female screw, the bodies A and B are connected firmly in a proper state. If the bodies A and B are not connected in a proper state, position error between the body A and the body B is caused and difference in level is generated at facing surfaces of the body A and the body B. If the difference in level is generated, eddy current is generated at step portion having the difference in level and pressure loss is also generated, when the engine rotates in a high speed, namely a lot of air flow the suction air passage. As a result, engine output is lowered.

In the embodiment shown by FIGS. 4A and 4B, since the body A and the body B are set in a proper location by engaging the protrusion 26 and the hole 19, the step portion is not formed at the inside wall surfaces of the bodies A and B and the pressure loss of suction air passage is not caused.

Figure 5A:
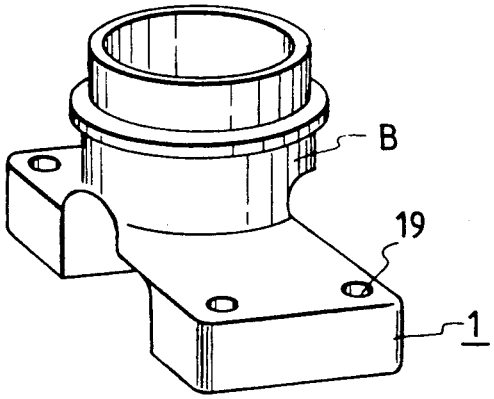
FIGS. 5A and 5B show perspective views of a throttle valve assembly relating to the third embodiment of the present invention, in which the throttle valve assembly is separated to each body element.
Figure 5B:
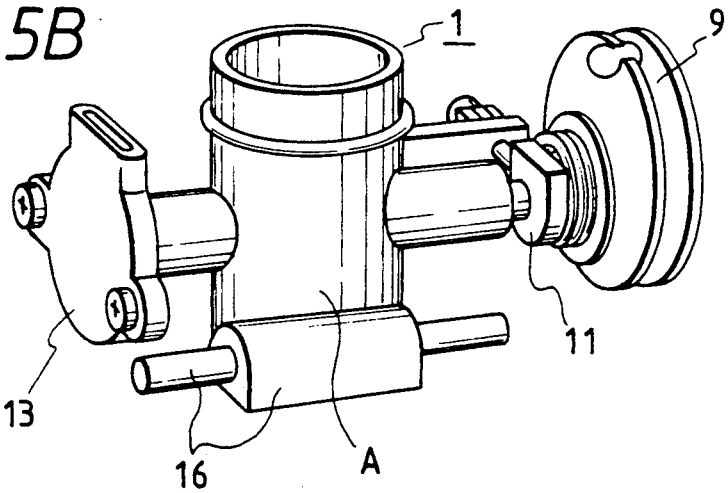

In FIGS. 5A and 5B, the same parts as in FIGS. 1 and 3A and 3B are indicated by the same symbols. Difference from FIGS. 1 and 3A and 3B in FIG. 5A and 5B is that a thermal conductive passage 16 for conducting an engine cooling water is provided at the light metal body A. The passage 16 can be contacted to an outside wall of the body A and also can be located within the body A.

When the body B is made by the synthetic resin, temperature of an engine is not easily transferred to the body A. In this case, if there is no any consideration mentioned above, when the engine is operated under a low temperature, frost or ice is produced at down stream side of the throttle valve 3 depending on difference of air density at upper stream side and down stream side of the throttle valve 3 and a suction air area of the throttle valve 3 is decreased generating so-called icing phenomenon.

Although the body B of the embodiment shown in FIGS. 5A and 5B is made by the synthetic resin, the above-mentioned icing phenomenon is not produced, since the body A is warmed by the passage 16 for conducting the engine cooling water.

Figure 6A:
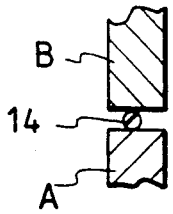
FIGS. 6A to 6G illustrate concrete constitution methods of the body A and the body B in the first, second and third embodiments mentioned above.

Referring to FIG. 6A, end portions of the bodies A and B face each other through the seal ring 14. Since the body A and the body B are connected by the fastening method shown in FIGS. 3A and 3B, FIGS. 4A and 4B and FIGS. 5A and 5B, the embodiment shown by FIG. 6A can also attain the object of the present invention.

Figure 6B:
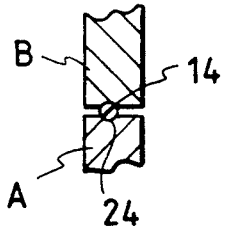

Different from FIGS. 6A in FIG. 6B is that grooves 24 are formed at the bodies A and B facing to each other and the seal member 14 is inserted to the grooves 24.

Figure 6C:
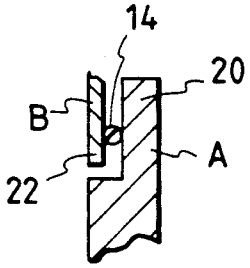

Referring to FIG. 6C, the end portion 22 of the body B extends straightly along the suction air passage 15 and the body A has a projection 20.

Figure 6D:
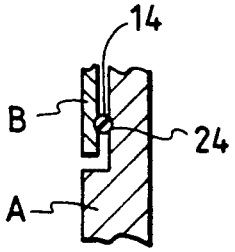

Different from FIG. 6C in FIG. 6D is that the grooves 24 are formed as well as FIG. 6B.

Figure 6E:
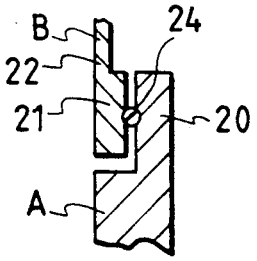
Figure 6F:
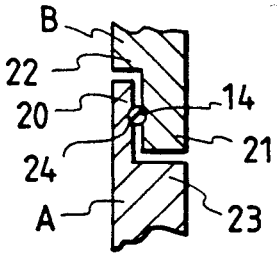

Referring to FIGS. 6E and 6F, the bodies A and B have protrusions 20 and 21, respectively.

Figure 6G:
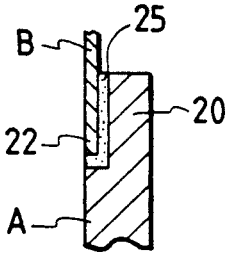

Referring to FIG. 6G, a silicon fill member 25 having elasticity even when volumes of the bodies A and B are changed is filled between the gap G formed by the bodies A and B.

According to the present invention, since the throttle body is divided into the body A having the operation space of the throttle valve and the body B connected to the body A and the throttle body is made by a synthetic resin except the body A, whole the throttle valve can be made light. Since the body A having the operation space of the throttle valve is made by a light metal in a necessary minimum region, the throttle valve assembly of the present invention can prevent the throttle valve from abutting to the inside wall of the throttle body and secure smooth throttle valve operation.

What we claim is:

1. A throttle valve assembly comprising a throttle valve, a throttle valve shaft for supporting the throttle valve along a radius direction of the throttle valve and a throttle body which installs the throttle valve and the throttle valve shaft in an inside thereof, wherein said throttle body comprises a first body which supports said throttle valve shaft and is made by a light metal and a second body which is connected coaxially to the first body and is made by a synthetic resin, and a seal member is inserted to a gap which is formed between said first body and said second body for absorbing thermal expansions by said first and second bodies.

2. A throttle valve assembly according to claim 1, wherein a seal member comprises an O ring.

3. A throttle valve assembly according to claim 1, wherein a seal member comprises a silicon fill member having an elasticity even when volumes of said first and second bodies are changed is filled to said gap.

4. A throttle valve assembly according to claim 1, wherein said first body forms a first protrusion extending along an axial direction thereof and a peripheral portion extending along an axis of said throttle valve shaft and an end portion of said second body faces to a surface formed by the first protrusion and the peripheral portion.

5. A throttle valve assembly according to claim 1, wherein said first body forms a first protrusion extending along an axial direction thereof and a peripheral portion extending along an axis of said throttle valve shaft and said second body forms a second protrusion at an end portion thereof and faces to a surface formed by the first protrusion and the peripheral portion.

6. A throttle valve assembly according to claim 1, wherein said first body is made by aluminum and said second body is made by polybutylene telephthalate or polyethylene telephthalate.

7. A throttle valve assembly according to claim 1, wherein a channel having a thermal conductivity and conducting a cooling water for an engine is provided at said first body or near said first body.

8. A throttle valve assembly according to claim 1, wherein said first body has a fixing portion located at an outside thereof and connected to said second body.

9. A throttle valve assembly according to claim 1, wherein a restricting member is mounted on said throttle valve shaft for maintaining a predetermined open degree of said throttle valve to an inside wall of said first body and a stopper for stopping the restricting member when said throttle valve closes is provided on a side of said first body.

10. A throttle valve assembly according to claim 2, wherein said O ring is inserted to grooves which are formed at said first and second bodies, respectively, and face each other across said gap.

* * * * *